US011342644B2

(12) United States Patent
Rhodes et al.

(10) Patent No.: US 11,342,644 B2
(45) Date of Patent: May 24, 2022

(54) MICROWAVE RESONATOR, A MICROWAVE FILTER AND A MICROWAVE MULTIPLEXER

(71) Applicant: ISOTEK MICROWAVE LIMITED, Leeds Yorkshire (GB)

(72) Inventors: John David Rhodes, Menston Yorkshire (GB); David Ibbetson, Oxenhope Yorkshire (GB); Vanessa Walker, Leeds Yorkshire (GB); Christopher Ian Mobbs, Harrogate Yorkshire (GB)

(73) Assignee: ISOTEK MICROWAVE LIMITED, Yorkshire (GB)

( * ) Notice: Subject to any disclaimer, the term of this patent is extended or adjusted under 35 U.S.C. 154(b) by 85 days.

(21) Appl. No.: 16/979,800

(22) PCT Filed: Feb. 28, 2019

(86) PCT No.: PCT/GB2019/050564
§ 371 (c)(1),
(2) Date: Sep. 10, 2020

(87) PCT Pub. No.: WO2019/175538
PCT Pub. Date: Sep. 19, 2019

(65) Prior Publication Data

US 2021/0043994 A1 Feb. 11, 2021

(30) Foreign Application Priority Data

Mar. 16, 2018 (GB) ..... 1804244
Nov. 21, 2018 (GB) ..... 1818940

(51) Int. Cl.
*H01P 1/208* (2006.01)
*H01P 7/06* (2006.01)
(Continued)

(52) U.S. Cl.
CPC ..... *H01P 1/2086* (2013.01); *H01P 1/2138* (2013.01); *H01P 7/06* (2013.01); *H01P 7/105* (2013.01)

(58) Field of Classification Search
CPC ..... H01P 1/2086; H01P 1/207; H01P 1/208; H01P 1/2082; H01P 1/2084;
(Continued)

(56) References Cited

U.S. PATENT DOCUMENTS 4,760,361 A * 7/1988 Kobayashi ..... H01P 1/2086 333/209
5,576,674 A * 11/1996 Jachowski ..... H01P 1/2086 333/212
(Continued)

FOREIGN PATENT DOCUMENTS

EP 0742603 A1 11/1996
EP 2797161 A1 10/2014
(Continued)

OTHER PUBLICATIONS

GB Intellectual Property Office Search Report issued in GB application No. GB1902699.6 dated Aug. 28, 2019.
(Continued)

*Primary Examiner* — Stephen E. Jones
(74) *Attorney, Agent, or Firm* — Quinn IP Law

(57) ABSTRACT

A microwave resonator comprising a hollow tube comprising an electrically conductive tube wall which defines a tube bore, the tube extending along a length axis from a first end to a second end; a first electrically conductive closing plate closing the first end of the tube, the first electrically conductive closing plate comprising at least one coupling slot extending therethrough; a second electrically conducting closing plate closing the second end of the tube, the second
(Continued)

electrically conductive closing plate comprising at least one coupling slot extending therethrough; a plurality of dielectric resonant pucks, each puck comprising first and second end faces and a side wall extending therebetween, each puck being dimensioned such that when in the tube its dominant mode is a doubly degenerate mode; the pucks being arranged within the tube bore spaced apart from each other and the closing plates, each puck being arranged centered on the length axis and its side wall abutting the tube wall such that there is no air gap between the puck and the tube wall which extends from one end face to the other of the puck, the puck adjacent to the first closing plate being termed the input puck; each puck being separated from the adjacent puck in the tube bore by a coupling gap, each coupling gap having an electrically conductive iris plate arranged therein, each iris plate being arranged normal to the length axis, each iris plate comprising at least one coupling slot extending therethrough; a single mode input microwave resonator adapted to provide a microwave signal to the input puck; each puck comprising a symmetry breaking structure for modifying the frequency of one of the degenerate modes relative to the other and the coupling between the two modes; each puck further comprising a central aperture extending from one end face to the other along the length axis; and, each central aperture comprising at least one electrically conductive insert arranged therein.

30 Claims, 7 Drawing Sheets

(51) Int. Cl.
*H01P 7/10* (2006.01)
*H01P 1/213* (2006.01)

(58) Field of Classification Search
CPC ..... H01P 1/2138; H01P 1/213; H01P 1/2133; H01P 7/06; H01P 7/10; H01P 7/105
See application file for complete search history.

(56) References Cited

U.S. PATENT DOCUMENTS

| | | | | |
|---|---|---|---|---|
| 5,804,534 | A * | 9/1998 | Zaki | H01P 1/2086 333/202 |
| 6,297,715 | B1 * | 10/2001 | Fiedziuszko | H01P 1/2086 333/202 |
| 2005/0270120 | A1 | 12/2005 | Guo | |
| 2016/0322687 | A1 | 11/2016 | Wei | |
| 2016/0322688 | A1 | 11/2016 | Wei | |

FOREIGN PATENT DOCUMENTS

| | | | |
|---|---|---|---|
| EP | 2887450 | A1 | 6/2015 |
| GB | 2559890 | A | 8/2018 |
| JP | H04296104 | A | 10/1992 |

OTHER PUBLICATIONS

International search report for the international application No. PCT/GB2019/050564, dated May 24, 2019.

* cited by examiner

MICROWAVE RESONATOR, A MICROWAVE FILTER AND A MICROWAVE MULTIPLEXER

The present invention relates to a microwave resonator. More particularly, but not exclusively, the present invention relates to a microwave resonator comprising a hollow tube defined by an electrically conductive tube wall, the tube being closed and both ends by closing plates having coupling slots extending therethrough, and a plurality of dielectric resonant pucks arranged in the tube spaced apart from each other, each puck being dimensioned to resonate in a doubly degenerate dominant mode, each puck comprising a symmetry breaking structure for modifying the frequency of one of the degenerate modes relative to the other and the coupling between the modes, each puck comprising a central aperture extending from one end face of the puck to the other, the central aperture having at least one electrically conductive insert arranged therein. The present invention also relates to a microwave filter comprising a plurality of such resonators. The present invention also relates to a multiplexer comprising a plurality of such resonators.

Microwave resonators are common components in microwave devices such as microwave filters and multiplexers. Such microwave resonators must typically meet a number of requirements. Preferably they are small to minimise the size of the microwave device. They should have a high Q factor and should also generate low passive intermodulation products. Preferably they should be able to operate when receiving a high-power signal. They should also be simple and inexpensive to manufacture.

The present invention seeks to overcome the problems of the prior art.

Accordingly, in a first aspect, the present invention provides a microwave resonator comprising a hollow tube comprising an electrically conductive tube wall which defines a tube bore, the tube extending along a length axis from a first end to a second end;

a first electrically conductive closing plate closing the first end of the tube, the first electrically conductive closing plate comprising at least one coupling slot extending therethrough;

a second electrically conductive closing plate closing the second end of the tube, the second electrically conductive closing plate comprising at least one coupling slot extending therethrough;

a plurality of dielectric resonant pucks, each puck comprising first and second end faces and a side wall extending therebetween, each puck being dimensioned such that when in the tube its dominant mode is a doubly degenerate mode;

the pucks being arranged within the tube bore spaced apart from each other and the closing plates, each puck being arranged centered on the length axis and its side wall abutting the tube wall such that there is no air gap between the puck and the tube wall which extends from one end face to the other of the puck, the puck adjacent to the first closing plate being termed the input puck;

each puck being separated from the adjacent puck in the tube bore by a coupling gap, each coupling gap having an electrically conductive iris plate arranged therein, each iris plate being arranged normal to the length axis, each iris plate comprising at least one coupling slot extending therethrough;

a single mode input microwave resonator adapted to provide a microwave signal to the input puck;

each puck comprising a symmetry breaking structure for modifying the frequency of one of the degenerate modes relative to the other and the coupling between the two modes;

each puck further comprising a central aperture extending from one end face to the other along the length axis; and each central aperture comprising at least one electrically conductive insert arranged therein.

The microwave resonator according to the invention is highly compact. It has a high Q and also produces low passive intermodulation products. It can receive a high-power microwave signal. It is also simple to manufacture. In particular the lack of an air gap between the pucks and the tube wall changes the resonant behaviour of the pucks enabling a significant reduction in size without loss of performance.

Further, the microwave resonator according to the invention is highly flexible. By simple modification of the symmetry breaking structure to change the relative frequencies and coupling between the modes one can significantly alter the behaviour of the resonator.

Preferably the end faces of the pucks are normal to the length axis.

Preferably for at least one puck at least one puck end face has a normal inclined to the length axis.

Preferably each remaining puck has end faces normal to the length axis.

Preferably each puck comprises at least one end face having a normal inclined to the length axis.

Preferably each insert abuts the wall of the central aperture in which it is arranged.

Preferably each insert is dimensioned such that there is no gap between the insert and the wall of the central aperture in which it is arranged.

Preferably at least one central aperture has a circular cross section normal to the length axis, each insert arranged within the central aperture of circular cross section comprising a rod of circular cross section, the diameter of the rod being equal to the diameter of the central aperture.

Alternatively at least one insert comprises an insert body and at least one resiliently deformable finger extending therefrom, the resiliently deformable finger being adapted to abut the wall of the central aperture in which it is arranged.

Preferably each puck has a thickness measured between the end faces of the puck, each insert having a thickness measured along the length axis which is less than the thickness of the puck in which it is arranged.

Preferably at least one central aperture comprises one insert only, the insert being centered half way between the end faces of the puck in which it is arranged.

Preferably at least one central aperture contains a plurality, preferably two, of inserts.

Preferably at least one of the pucks is of a different thickness to the remaining pucks.

Preferably each of the pucks is dimensioned such that the dominant mode is a $EH_{111}$ mode.

Preferably the end faces of each puck are circular in a plane normal to the length axis.

Preferably the thickness of at least one coupling gap measured along the length axis is different to that of the remaining coupling gaps.

Preferably the separation between the first closing plate and the input puck is between 0.25 and 0.75 times the thickness of the input puck, more preferably between 0.4 and 0.6 times the thickness of the input puck.

Preferably each iris plate comprises a single coupling slot.

Alternatively, each iris plate comprises two coupling slots, one normal to the other.

Preferably the microwave resonator comprises two pucks only, the two pucks having an iris plate arranged therebetween.

Preferably the single mode input microwave resonator comprises a combline resonator, the combline resonator comprising an electrically conductive cavity wall defining a cavity and a central resonator body extending into the cavity from the cavity wall, the coupling slot of the first closing plate extending through the cavity wall.

Preferably the central resonator body extends normal to the length axis.

Preferably the puck adjacent to the second closing plate is termed the output puck, the microwave resonator further comprising a single mode output microwave resonator adapted to receive a microwave signal from the output puck.

Preferably the single mode output microwave resonator comprises a combline resonator, the combline resonator comprising an electrically conductive cavity wall defining a cavity and a central resonator body extending into the cavity from the cavity wall, the coupling slot of the second closing plate extending through the cavity wall.

Preferably the resonator body extends normal to the length axis.

Preferably the symmetry breaking structure of at least one puck, preferably each puck, comprises at least one, preferably a plurality of apertures extending at least part way through the puck at least part way from one end face to the other spaced parallel to but spaced apart from the length axis.

Preferably at least one aperture, preferably each aperture extends from one end face to the other of the puck in which it is arranged Preferably for at least one puck at least one aperture is of a different dimensions or distance from the length axis to the apertures of the remaining pucks.

In a further aspect of the invention there is provided a microwave filter comprising a plurality of microwave resonators as claimed in any one of claims 1 to 27, connected together in parallel or cascade.

In a further aspect of the invention there is provided a microwave multiplexer comprising a plurality of microwave resonators as claimed in any one of claims 1 to 27.

The present invention will now be described by way of example only and not in any limitative sense with reference to the accompanying drawings in which FIG. 1 shows a portion of a microwave resonator according to the invention in vertical cross section;

Figure 7A:
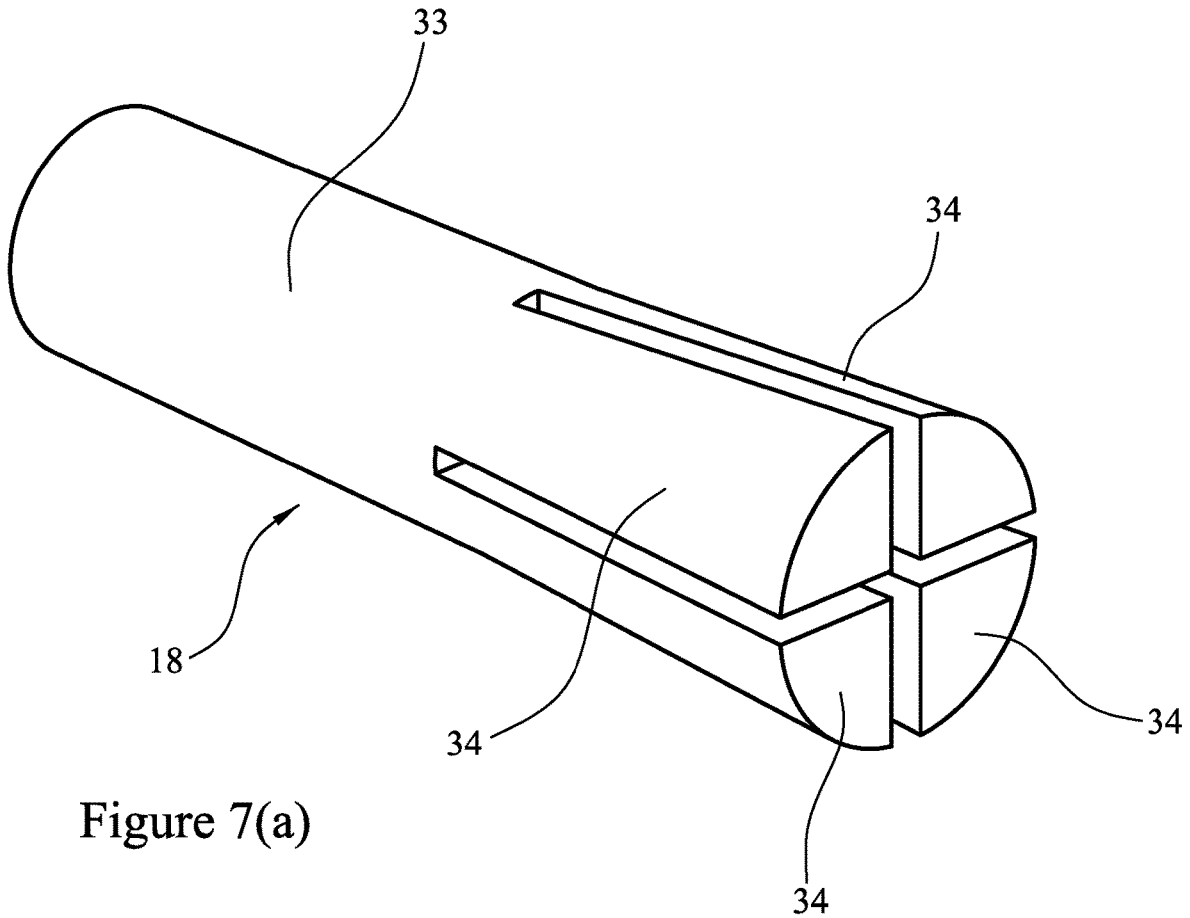
Figure 7B:
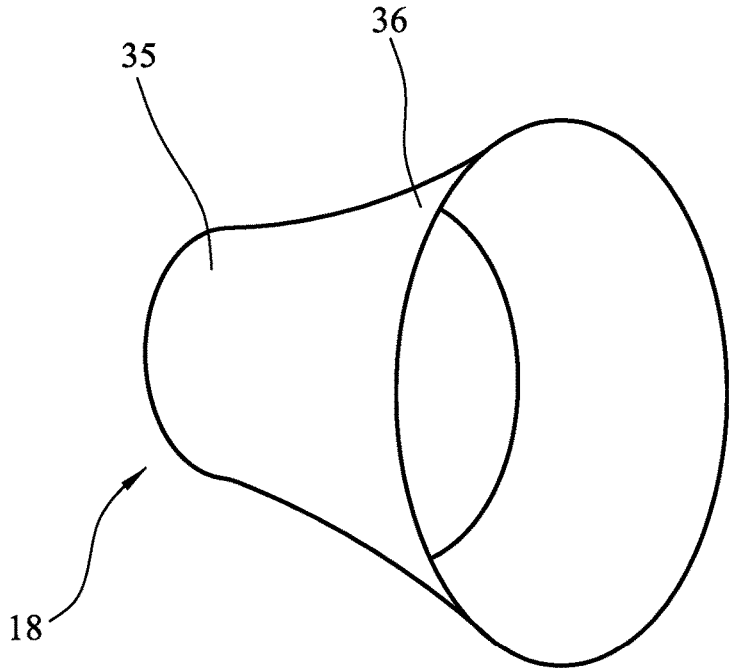
Figure 8:
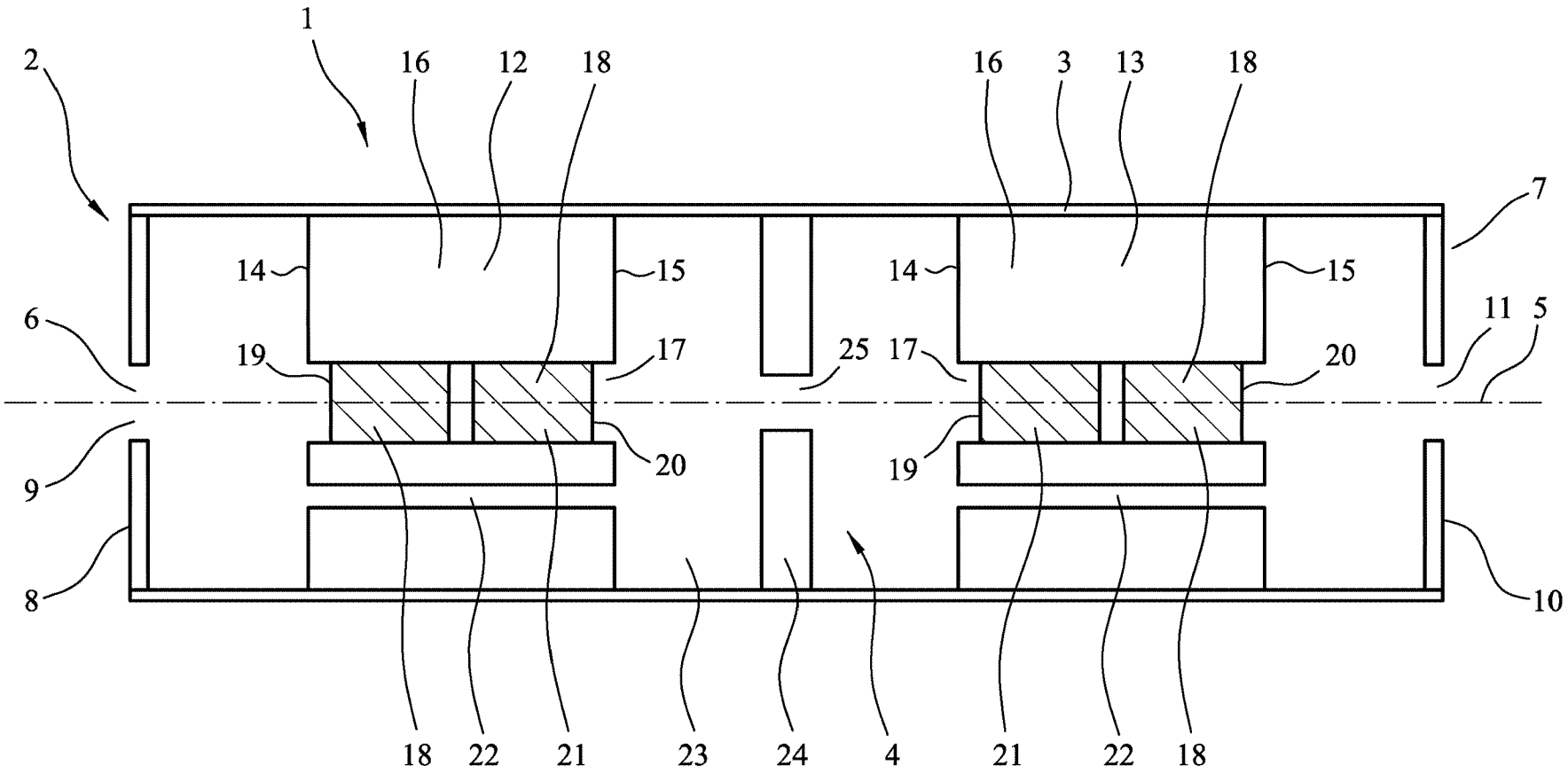

FIGS. 7(*a*) and 7(*b*) show variants of inserts of microwave resonators according to the invention; and FIG. 8 shows a portion of a further embodiment of a microwave resonator according to the invention.

Figure 1:
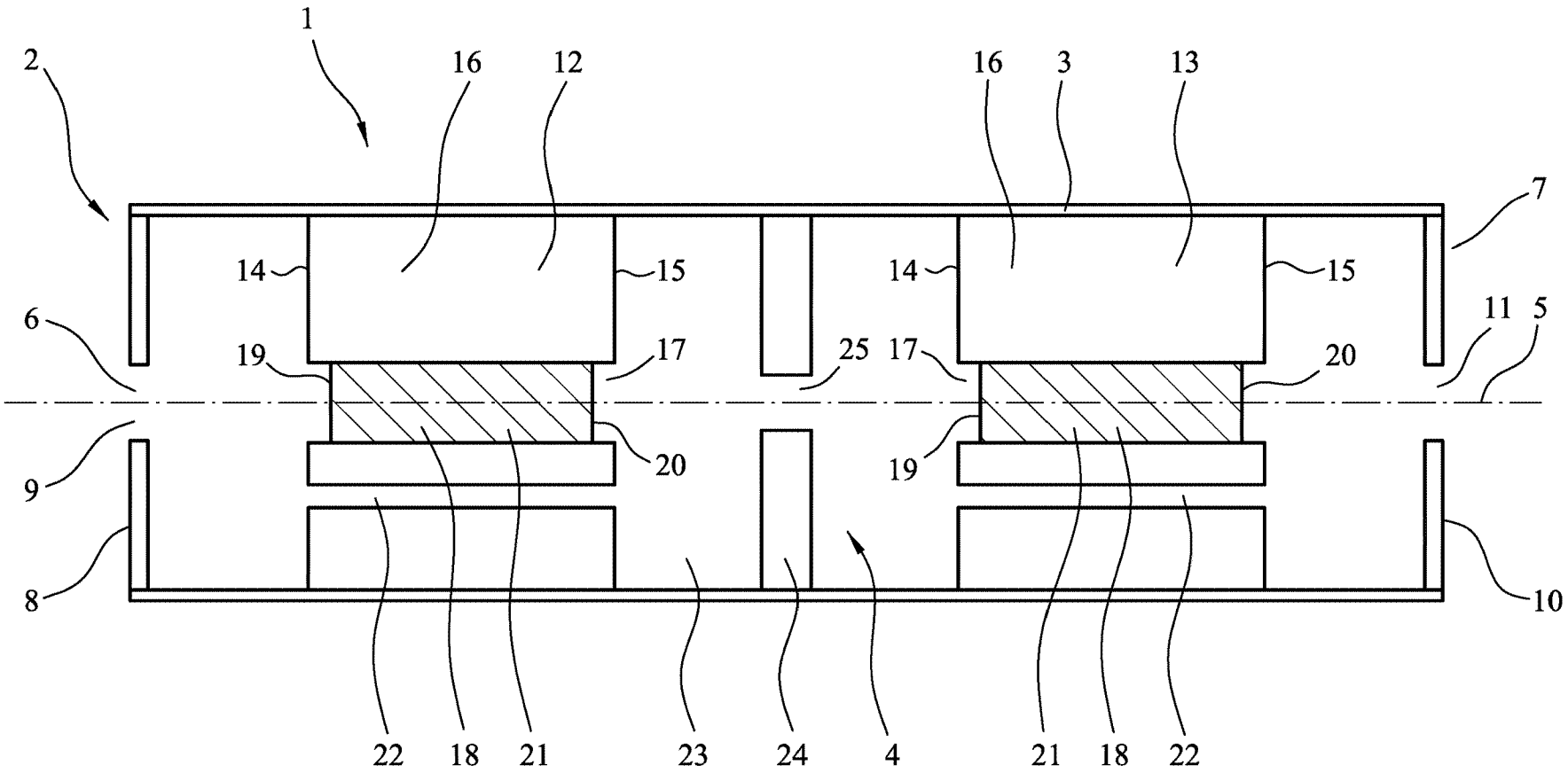

Shown in FIG. 1 is a portion of a microwave resonator 1 according to the invention in vertical cross section.

The microwave resonator 1 comprises a hollow tube 2. The tube 2 comprises an electrically conductive tube wall 3 which defines a tube bore 4. A length axis 5 extends along the centre of the tube 2 from a first end 6 of the tube 2 to a second end 7 of the tube 2. The tube bore 4 of this embodiment of the invention is circular normal to the length axis 5.

A first electrically conductive closing plate 8 closes the first end 6 of the tube 2. A coupling slot 9 extends through the first closing plate 8. A second electrically conductive closing plate 10 closes the second end 7 of the tube 2. A coupling slot 11 extends through the second closing plate 10.

Arranged within the tube bore 4 are first and second dielectric resonant pucks 12,13. Each puck comprises first and second end faces 14,15 and a side wall 16 extending therebetween. In this embodiment the end faces 14,15 of each of the pucks 12,13 are circular. The diameter of each of the end faces 14,15 is equal to the diameter of the tube bore 4 such that the side wall 16 abuts the tube 2 over the entirety of the side wall 16 such that there is no air gap between the side wall 16 of the puck 12,13 and the tube wall 3. To put this another way, if one were to look along the bore 4 of the tube 2 o0ne could not see past the puck 12,13 through a gap between the puck 12,13 and tube wall 3.

Each puck 12,13 has a central aperture 17 which extends from one end face 14 of the puck 12,13 to the other end face 15 along the length axis 5. In this embodiment the central aperture 17 is circular in cross section in a plane normal to the length axis 5. Arranged in each central aperture 17 is at least one (in this case one) electrically conductive insert 18. In this embodiment the insert 18 is cylindrical having first and second insert end faces 19,20 and a insert side wall 21 extending therebetween. The diameter of the insert 18 is equal to the diameter of the central aperture 17 such that the insert side wall 21 abuts the wall defining the central aperture 17.

Each puck 12,13 has a thickness measured along the length axis 5 from one puck end face 14 to the other end face 15. Similarly, each insert 18 has a thickness measured along the length axis 5 from one insert end face 19 to the other insert end face 20. For each puck 12,13 the thickness of the insert 18 in the central aperture 17 of that puck 12,13 is less than the thickness of the puck 12,13. Typically, each puck 12,13 is centred half way between the end faces 14,15 of its associated puck 12,13 as shown. As the thickness of each puck 12,13 is slightly larger than the thickness of its associated insert 18 the insert end faces 19,20 are slightly recessed in the end faces 14,15 of the puck 12,13 as shown. The function of the insert 18 is described in more detail below.

Each puck 12,13 further comprises a symmetry breaking structure 22. In this embodiment the symmetry breaking structure 22 of each puck 12,13 comprises an aperture 22 extending from one end face 14 of the puck 12,13 to the other end face 15 parallel to but spaced apart from the length axis 5. The symmetry breaking structure 22 couples the two degenerate modes of the puck 12,13 together modifying the frequency of the one of the degenerate modes relative to the other and the coupling between the two modes. The function of the symmetry breaking structure 22 is described in more detail below.

The puck 12 adjacent to the first closing plate 8 is termed the input puck 12. The face 14 of the input puck 12 adjacent to the first closing plate 8 is termed the input face 14. The puck 13 adjacent to the second closing plate 10 is termed the output puck 13. The face 15 of the output puck 13 adjacent to the second closing plate 10 is termed the output face 15.

The separation between the first closing plate 8 and the input face 14 of the input puck 12 is typically between 0.25 and 0.75 times the thickness of the input puck 12, more preferably between 0.4 and 0.6 times the thickness of the input puck 12. In this embodiment the separation between the first closing plate 8 and the input face 14 is 0.5 times the thickness of the input puck 12.

Similarly, the separation between the second closing plate 10 and the output face 15 of the output puck 13 is typically between 0.25 and 0.75 times the thickness of the output puck 13, more preferably between 0.4 and 0.6 times the thickness of the output puck 13. In this embodiment the separation between the second closing plate 10 and the output face 15 of the output puck 13 is 0.5 times the thickness of the output puck 13.

The dielectric of each puck 12,13 typically has a dielectric constant in the range 10 to 80. More typically the dielectric constant has any of the values 10, 20, 40 and 80 to within ten percent. Higher dielectric constants are used in resonators operating at lower frequencies.

Each puck 12,13 is dimensioned such that its dominant mode is a doubly degenerate mode, preferably the $EH_{111}$ mode.

The two pucks 12,13 are spaced apart by a coupling gap 23 extending therebetween. Arranged within the coupling gap 23 is an electrically conductive iris plate 24. The iris plate 24 in this embodiment is arranged equally spaced apart from the two pucks 12,13. The iris plate 24 is arranged normal to the length axis 5 as shown. The iris plate 24 is circular and has a diameter equal to that of the tube bore 4 such that the edge of the iris plate 24 abuts the tube bore 4 around the edge of the iris plate 24. Extending through the iris plate 24 is a coupling slot 25.

Figure 2:
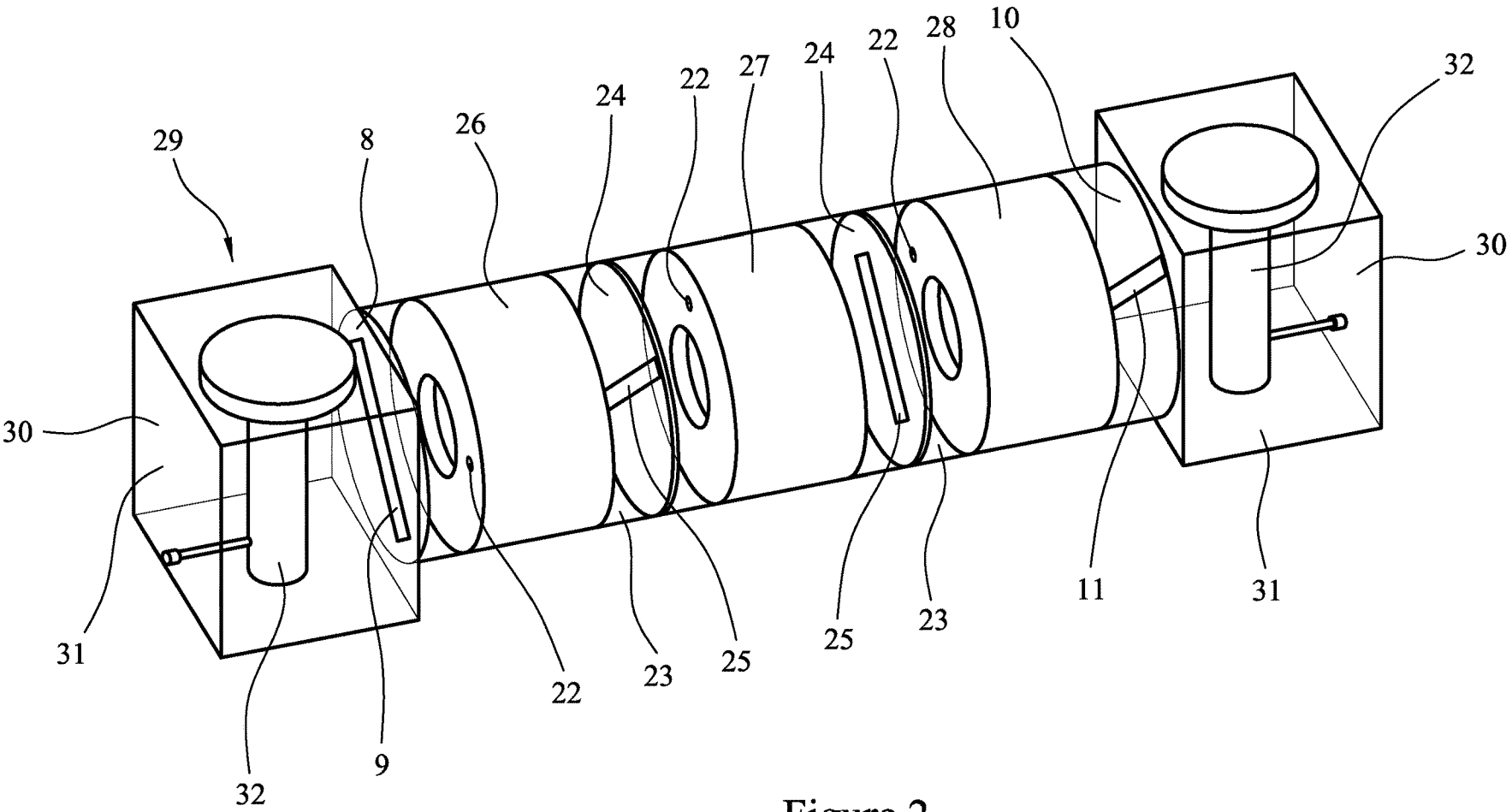
FIG. 2 shows a microwave resonator according to the invention in perspective view.

Shown in FIG. 2 in perspective view is a microwave resonator 1 according to the invention in perspective view. The microwave resonator 1 comprises three dielectric resonant pucks 26,27,28 arranged in the tube bore 4. Arranged in the central aperture of each puck 126,27,28 is an electrically conductive insert 18. Arranged in the coupling gap 23 between each of the pucks 26,27,28 is an iris plate 24. Extending through each iris plate 24 is a coupling slot 25. Each coupling slot 25 extends in the plane of its iris plate 24 through the length axis 5 towards the tube wall 3. As can been seen the coupling slots 25 of the iris plates 24 are not parallel. In this embodiment the coupling slot 25 in one iris plate 24 extends normal to the coupling slot 25 in the other iris plate 24 in the plane normal to the length axis 5.

The tube 2 is closed by first and second closing plates 8,10. Each closing plate 8,10 has a coupling slot 9,11 extending therethrough. The two coupling slots 9,11 of the closing plates 8,10 extend normal to each other in the plane normal to the length axis 5 as shown. Each closing plate coupling slot 9,11 also extends normal to the coupling slot 25 of its adjacent iris plate 24 in the plane normal to the length axis 5.

Typically not all of the pucks 26,27,28 are of the same thickness. Similarly the thickness of the coupling gaps 23 measured along the length axis 5 are typically not all the same. Typically the thickness of at least one coupling gap 23 is different to the remaining coupling gaps 23. Each puck 26,27,28 comprises a symmetry breaking structure 22 which comprises an aperture 22 extending from one end face 14 of the puck 26,27,28 to the other, parallel to but spaced apart from the length axis 5.

The microwave resonator 1 further comprises a single mode input microwave resonator 29 which is adapted to provide a microwave signal to the input puck 26. The single mode input microwave resonator 29 is a combline resonator. The combline resonator comprises an electrically conductive cavity wall 30 which defines a cavity 31. Extending from the cavity wall 30 into the cavity 31 is an electrically conductive central resonator body 32. The central resonator body 32 extends into the cavity 31 normal to the length axis 5 as shown. The coupling slot 9 of the first closing plate 8 extends through the cavity wall 30 so coupling the combline resonator to the pucks 26,27,28 in the tube 2.

The microwave resonator 1 further comprises a single mode output microwave resonator 33 which receives a microwave signal from the output puck 28. The single mode output microwave resonator 33 is a combline resonator. The combline resonator comprises an electrically conductive cavity wall 30 which defines a cavity 31. Extending from the cavity wall 30 into the cavity 31 is an electrically conductive central resonator body 32. The central resonator body 32 extends into the cavity 31 normal to the length axis 5 as shown. The coupling slot 11 of the second closing plate 10 extends through the cavity wall 30 so coupling the combline resonator to the pucks 26,27,28 in the tube 2. As the central resonator bodies 32 are arranged normal to the length axis 5 then the magnetic field generated by the input combline resonator 29 will couple energy into the fundamental dual modes whereas the coupling into the first spurious modes will be negligible.

In use a microwave signal is provided to the single mode input microwave resonator 29. This signal couples through the coupling slot 9 in the first closing plate 8 to the two degenerate modes of the input puck 26. The microwave signal passes through the coupling slot 25 in the iris plate 24 to excite corresponding modes in the next puck 27. The signal from here passes through the coupling slot 25 in the next iris plate 24 to excite the two degenerate modes in the output puck 28. The two modes in the output puck 28 couple to the single mode output microwave resonator 33 so producing the output signal. The coupling between the degenerate modes of the different pucks 26,27,28 results in the microwave resonator 1 having a number of transmission zeros.

Figure 3:
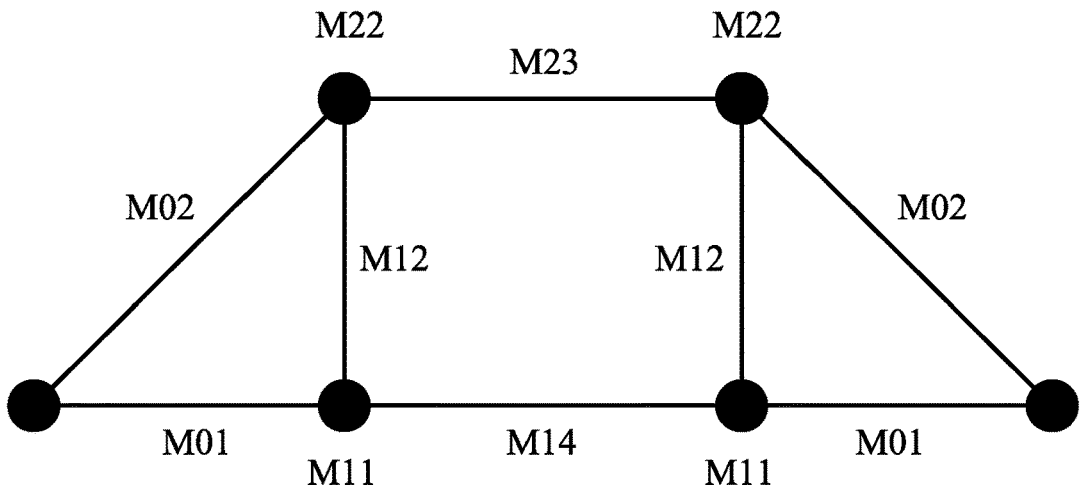
FIG. 3 shows an equivalent circuit of a microwave resonator according to the invention.

The operation of a microwave resonator 1 according to the invention can be explained in more detail with reference to FIG. 3. FIG. 3 shows an equivalent circuit for a microwave resonator 1 comprising two pucks 12,13 only separated by an iris plate 24. The iris plate 24 comprises two coupling slots 25, one normal to the other. Each mode of a puck 12,13 is represented by a node. A first mode in each of the two pucks 12,13 is $M_{11}$. The second mode in each of the two pucks 12,13 is $M_{22}$. $M_{11}$ and $M_{22}$ represent the deviation in frequency for the modes from the central frequency. The coupling between the first mode in one puck 12 and the first mode in the other puck 13 is $M_{14}$. The coupling between the second mode in one puck 12 and the second mode in the other puck 13 is $M_{23}$. The coupling between the two modes in each puck 12,13 is $M_{12}$. The coupling between the single mode input microwave resonator 29 and the two modes in the input puck 12 (and also the coupling between the single mode output microwave resonator 33 and the two modes in the output puck 13) is $M_{01}$ and $M_{02}$ respectively. There is no coupling between a mode in one puck 12 and a different mode in the other puck 13.

It is the distance between the iris plate 24 and the pucks 12,13 that determines the magnitude of the coupling between a mode in one puck 12 and the corresponding mode in the other puck 13. The strength of this coupling however is modified by the areas of the coupling slots 25 in the iris plate 24. The area of one slot 25 relative to the other determines the relative strength of the couplings $M_{23}$ and $M_{14}$. In the extreme one coupling slot 25 can be reduced in length and increased in width to such an extent that it lies within the other coupling slot 25 so resulting in an iris plate 24 having one coupling slot 25 only, as per FIG. 2.

Turning now to the symmetry breaking structure 22 of a puck 12,13, this typically comprises an aperture 22 extending from one end face 14 of the puck 12,13 to the other end face 15, parallel to but spaced apart from the length axis 5. By suitable dimensioning and positioning of this aperture 22 with respect to the slot or slots 25 in the adjacent iris plate 24 and also the distance of the aperture 22 from the length axis 5 one changes the coupling between the two modes in the puck 12,13 and also their relative frequencies $M_{11}$ and $M_{22}$.

Figure 4:
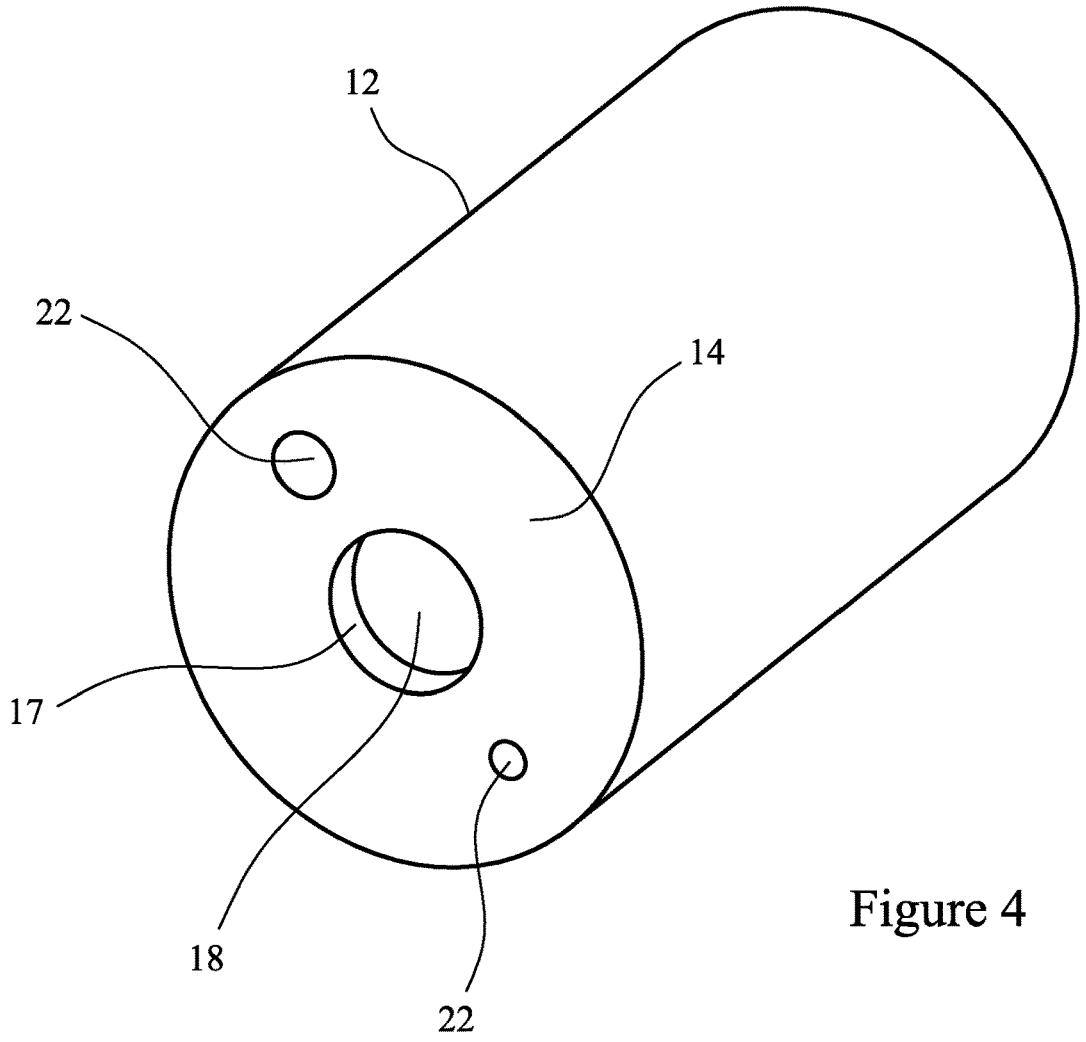
FIG. 4 shows a puck of a microwave resonator according to the invention in perspective view.

More generally the symmetry breaking structure 22 of a puck 12,13 may comprise two apertures 22, each parallel to but spaced apart from the length axis 5. A puck 12 comprising such a symmetry breaking structure 22 is shown in FIG. 4. The apertures 22 are not necessarily of the same size. In this embodiment one aperture 22 has a larger area than the other. A line drawn between the apertures 22 typically passes through the centre of the puck face 14.

One can analyse the equivalent circuit for a microwave resonator 1 according to the invention for a given set of couplings and resonant frequencies. These can then be adjusted to produce a microwave resonator 1 with the desired behaviour. This can then be realised as a microwave resonator 1 with the distance between the pucks 12,13 and the iris plate 24, the sizes of the coupling slots 25 and the positions and sizes of the apertures 22 of the symmetry breaking structure 22 set appropriately.

Changes to the design of the microwave resonator 1 can significantly alter its behaviour. Changing the couplings between the modes within a puck 12,13 and the couplings between modes in different pucks 12,13 can move the transmission zeros of the resonator 1 to above or below the passband.

The microwave resonator 1 according to the invention finds particular application at resonant frequencies below 1 GHz. In order to achieve this one capacitively loads the dielectric pucks 12,13 reducing the resonant frequency of the fundamental dual mode resonance whilst maintaining a significant resonant frequency separation for other spurious modes.

This capacitive loading is achieved by arranging an electrically conductive insert 18 in the central aperture 17 of each puck 12,13. As with all other electrically conductive components of the microwave resonator 1 the insert 18 is typically a metal. The insert 18 is typically a rod of circular cross section in a plane normal to the length axis 5. The insert 18 abuts the wall defining the central aperture 17.

The larger the diameter of the insert 18 then the greater the reduction in resonant frequency of the fundamental dual mode resonance of the puck 12,13 containing the insert 18. A problem however arises with the thickness of the insert 18, measured along the length axis. Introduction of the insert 18 creates a TEM mode between the insert 18 and tube 2. Increasing the thickness of the insert 18 causes the resonant frequency of this TEM mode to reduce towards the fundamental resonance. Ideally the thickness of the insert 18 should be such that the resonant frequency of this TEM mode is comparable to the next highest doubly degenerate mode.

As a specific example a puck 12 is provided having a diameter of 38 mm and which is 20 mm thick. It has a central aperture 17 which is 15.3 m in diameter passing from the centre of one puck end face 14 to the centre of the other puck end face 15. A metal insert 18 is inserted symmetrically into the central aperture 17 with a diameter of 15.3 mm but only 14 mm long. When this puck 12 is inserted into a tube 2 having a tube bore 4 of 38 mm in diameter closed by closing plates 8,10 it has a fundamental dual mode resonance (EH111) at 787 MHz with a high unloaded Q factor of 4400. The first spurious modes are at 1.21 GHz for the quasi TEM mode ($EH_{001}$) and 1.29 GHz for the doubly degenerate $EH_{211}$ mode.

All of the microwave resonators 1 previously described may be employed in larger structures. They may be employed in filters comprising a plurality of such resonators 1. The resonators 1 may be connected together in parallel or cascade. They may also be employed in multiplexers (the term being used broadly to cover both multiplexers and demultiplexers). A multiplexer would typically employ a plurality of such resonators 1.

Figure 5:
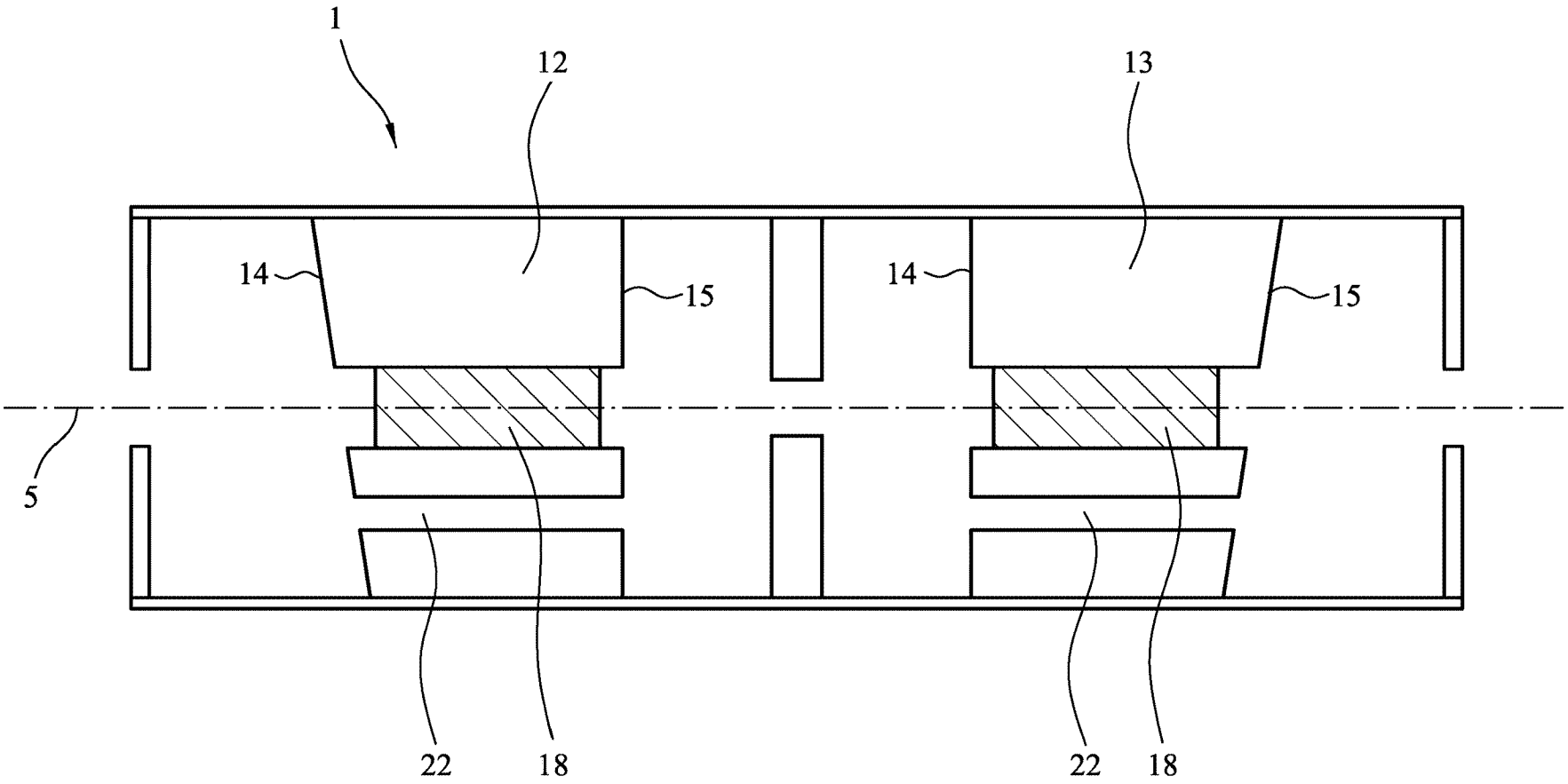
FIG. 5 shows a portion of a further embodiment of a microwave resonator according to the invention in vertical cross section.

Shown in FIG. 5 is a portion of a further embodiment of a microwave resonator 1 according to the invention in vertical cross section. This is similar to that of FIG. 1 except each puck 12,13 has one end face 14 having a normal which is inclined to the length axis 5. This slight asymmetry of the puck 12,13 couples the modes together within the puck 12,13.

Figure 6:
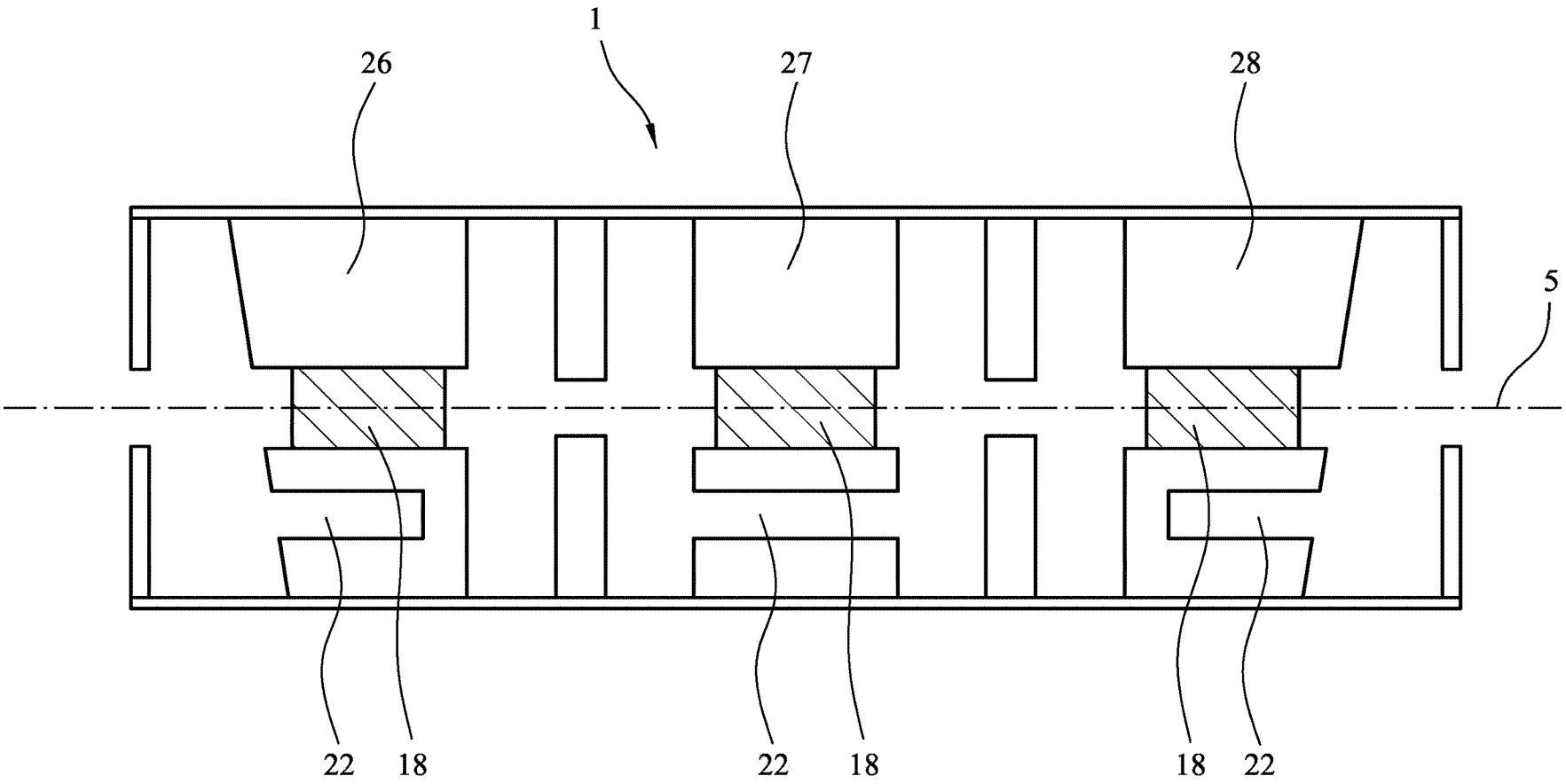
FIG. 6 shows a portion of a further embodiment of a microwave resonator according to the invention in vertical cross section.

Shown in FIG. 6 is a further embodiment of a portion of a microwave resonator 1 according to the invention in vertical cross section. This is similar to that of FIG. 5 except it now includes a third puck 27. The end faces of the third puck 27 are normal to the length axis 5. In this embodiment the symmetry breaking structure 22 of the central puck 27 extends through the puck 27 from one end face to the other. The symmetry breaking structure 22 of the other two pucks 26,28 extends only part way through the pucks 26,28.

In all of the above embodiments the insert 18 is a rod. Alternative forms of insert 18 are possible. Shown in FIG. 7(*a*) is an alternative form of insert 18. The inert 18 comprises an insert body 33. Extending from the insert body 33 is a plurality of resiliently deformable insert fingers 34. When the insert 18 is inserted into the central aperture 17 the fingers 34 abut the wall of the central aperture 17 so holding the insert 18 in place.

FIG. 7(*b*) shows a further embodiment of an insert 18. The insert 18 comprises an insert body 35. Extending from the insert body 35 is a resiliently deformable finger in the form of a skirt 36. As the insert 18 is inserted into the central aperture 17 the skirt 36 is compressed by the wall of the central aperture 17, so holding the insert 18 in place.

Shown in FIG. 8 is a further embodiment of a microwave resonator 1 according to the invention. This is similar to the embodiment of FIG. 1 except each central aperture 17 now comprises a plurality (in this case two) electrically conductive inserts 18.

The invention claimed is:

1. A microwave resonator comprising:

a hollow tube comprising an electrically conductive tube wall which defines a tube bore, the tube extending along a length axis from a first end to a second end;

a first electrically conductive closing plate closing the first end of the tube, the first electrically conductive closing plate comprising at least one coupling slot extending therethrough;

a second electrically conductive closing plate closing the second end of the tube, the second electrically conductive closing plate comprising at least one coupling slot extending therethrough;

a plurality of dielectric resonant pucks, each puck comprising first and second end faces and a side wall extending therebetween, each puck being dimensioned such that when in the tube its dominant mode is a doubly degenerate mode;

the pucks being arranged within the tube bore spaced apart from each other and the closing plates, each puck being arranged centered on the length axis and its side wall abutting the tube wall such that there is no air gap between the puck and the tube wall which extends from one end face to the other of the puck, the puck adjacent to the first closing plate being termed the input puck;

each puck being separated from the adjacent puck in the tube bore by a coupling gap, each coupling gap having an electrically conductive iris plate arranged therein, each iris plate being arranged normal to the length axis, each iris plate comprising at least one coupling slot extending therethrough;

a single mode input microwave resonator adapted to provide a microwave signal to the input puck;

each puck comprising a symmetry breaking structure for modifying the frequency of one of the degenerate modes relative to the other and the coupling between the two modes;

each puck further comprising a central aperture extending from one end face to the other along the length axis; and, each central aperture comprising at least one electrically conductive insert arranged therein.

2. The microwave resonator as claimed in claim 1 wherein the end faces of the pucks are normal to the length axis.

3. The microwave resonator as claimed in claim 1, wherein for at least one puck at least one puck end face has a normal inclined to the length axis.

4. The microwave resonator as claimed in claim 3, wherein each remaining puck has end faces normal to the length axis.

5. The microwave resonator as claimed in claim 3, wherein each puck comprises at least one end face having a normal inclined to the length axis.

6. The microwave resonator as claimed in claim 1, wherein each insert abuts the wall of the central aperture in which it is arranged.

7. The microwave resonator as claimed in claim 6, wherein each insert is dimensioned such that there is no gap between the insert and the wall of the central aperture in which it is arranged.

8. The microwave resonator as claimed in claim 7, wherein at least one central aperture has a circular cross section normal to the length axis, each insert arranged within the central aperture of circular cross section comprising a rod of circular cross section, the diameter of the rod being equal to the diameter of the central aperture.

9. The microwave resonator as claimed in claim 6, wherein at least one insert comprises an insert body and at least one resiliently deformable finger extending therefrom, the resiliently deformable finger being adapted to abut the wall of the central aperture in which it is arranged.

10. The microwave resonator as claimed in claim 1, wherein each puck has a thickness measured between the end faces of the puck, each insert having a thickness measured along the length axis which is less than the thickness of the puck in which it is arranged.

11. The microwave resonator as claimed in claim 1, wherein at least one central aperture contains one insert only, the insert being centered half way between the end faces of the puck in which it is arranged.

12. The microwave resonator as claimed in claim 1, wherein at least one central aperture contains a plurality, preferably two, of inserts.

13. The microwave resonator as claimed in claim 1, wherein at least one of the pucks is of a different thickness to the remaining pucks.

14. The microwave resonator as claimed in claim 1, wherein each of the pucks is dimensioned such that the dominant mode is a $EH_{111}$ mode.

15. The microwave resonator as claimed in claim 1, wherein the end faces of each puck are circular in a plane normal to the length axis.

16. The microwave resonator as claimed in claim 1, wherein the thickness of at least one coupling gap measured along the length axis is different to that of the remaining coupling gaps.

17. The microwave resonator as claimed in claim 1, wherein the separation between the first closing plate and the input puck is between 0.25 and 0.75 times the thickness of the input puck, more preferably between 0.4 and 0.6 times the thickness of the input puck.

18. The microwave resonator as claimed in claim 1, wherein each iris plate comprises a single coupling slot.

19. The microwave resonator as claimed in claim 1, wherein each iris plate comprises two coupling slots, one normal to the other.

20. The microwave resonator as claimed in claim 1, comprising two pucks only, the two pucks having an iris plate arranged therebetween.

21. The microwave resonator as claimed in claim 1, wherein the single mode input microwave resonator comprises a combline resonator, the combline resonator comprising an electrically conductive cavity wall defining a cavity and a central resonator body extending into the cavity from the cavity wall, the coupling slot of the first closing plate extending through the cavity wall.

22. The microwave resonator as claimed in claim 21, wherein the central resonator body extends normal to the length axis.

23. The microwave resonator as claimed in claim 1, wherein the puck adjacent to the second closing plate is termed the output puck, the microwave resonator further comprising a single mode output microwave resonator adapted to receive a microwave signal from the output puck.

24. The microwave resonator as claimed in claim 23, wherein the single mode output microwave resonator comprises a combline resonator, the combline resonator comprising an electrically conductive cavity wall defining a cavity and a central resonator body extending into the cavity from the cavity wall, the coupling slot of the second closing plate extending through the cavity wall.

25. The microwave resonator as claimed in claim 24, wherein the resonator body extends normal to the length axis.

26. The microwave resonator as claimed in claim 1, wherein the symmetry breaking structure of at least one puck, preferably each puck, comprises at least one, preferably a plurality of apertures extending at least part way through the puck from one end face to the other spaced parallel to but spaced apart from the length axis.

27. The microwave resonator as claimed in claim 26 wherein at least one aperture, preferably each aperture extends from one end face to the other of the puck in which it is arranged.

28. The microwave resonator as claimed in claim 26, wherein for at least one puck at least one aperture is of a different dimensions or distance from the length axis to the apertures of the remaining pucks.

29. A microwave filter comprising:

a plurality of microwave resonators;

at least one microwave resonator of the plurality of microwave resonators including:

a hollow tube comprising an electrically conductive tube wall which defines a tube bore, the tube extending along a length axis from a first end to a second end;

a first electrically conductive closing plate closing the first end of the tube, the first electrically conductive closing plate comprising at least one coupling slot extending therethrough;

a second electrically conductive closing plate closing the second end of the tube, the second electrically conductive closing plate comprising at least one coupling slot extending therethrough;

a plurality of dielectric resonant pucks, each puck comprising first and second end faces and a side wall extending therebetween, each puck being dimensioned such that when in the tube its dominant mode is a doubly degenerate mode;

the pucks being arranged within the tube bore spaced apart from each other and the closing plates, each puck being arranged centered on the length axis and its side wall abutting the tube wall such that there is no air gap between the puck and the tube wall which extends from one end face to the other of the puck, the puck adjacent to the first closing plate being termed the input puck;

each puck being separated from the adjacent puck in the tube bore by a coupling gap, each coupling gap having an electrically conductive iris plate arranged therein, each iris plate being arranged normal to the length axis, each iris plate comprising at least one coupling slot extending therethrough;

a single mode input microwave resonator adapted to provide a microwave signal to the input puck;

each puck comprising a symmetry breaking structure for modifying the frequency of one of the degenerate modes relative to the other and the coupling between the two modes;

each puck further comprising a central aperture extending from one end face to the other along the length axis; and, each central aperture comprising at least one electrically conductive insert arranged therein; and wherein the plurality of microwave resonators are connected together in parallel or cascade.

30. A microwave multiplexer comprising:

a plurality of microwave resonators;

at least one microwave resonator of the plurality of microwave resonators including:

a hollow tube comprising an electrically conductive tube wall which defines a tube bore, the tube extending along a length axis from a first end to a second end;

a first electrically conductive closing plate closing the first end of the tube, the first electrically conductive closing plate comprising at least one coupling slot extending therethrough;

a second electrically conductive closing plate closing the second end of the tube, the second electrically conductive closing plate comprising at least one coupling slot extending therethrough;

a plurality of dielectric resonant pucks, each puck comprising first and second end faces and a side wall extending therebetween, each puck being dimensioned such that when in the tube its dominant mode is a doubly degenerate mode;

the pucks being arranged within the tube bore spaced apart from each other and the closing plates, each puck being arranged centered on the length axis and its side wall abutting the tube wall such that there is no air gap between the puck and the tube wall which extends from one end face to the other of the puck, the puck adjacent to the first closing plate being termed the input puck;

each puck being separated from the adjacent puck in the tube bore by a coupling gap, each coupling gap having an electrically conductive iris plate arranged therein, each iris plate being arranged normal to the length axis, each iris plate comprising at least one coupling slot extending therethrough;

a single mode input microwave resonator adapted to provide a microwave signal to the input puck;

each puck comprising a symmetry breaking structure for modifying the frequency of one of the degenerate modes relative to the other and the coupling between the two modes;

each puck further comprising a central aperture extending from one end face to the other along the length axis; and, each central aperture comprising at least one electrically conductive insert arranged therein.

* * * * *